US009399936B2

(12) United States Patent
Takasugi et al.

(10) Patent No.: US 9,399,936 B2
(45) Date of Patent: Jul. 26, 2016

(54) EXHAUST APPARATUS

(71) Applicant: KAWASAKI JUKOGYO KABUSHIKI KAISHA, Kobe-shi, Hyogo (JP)

(72) Inventors: Yuji Takasugi, Amagasaki (JP); Tetsuya Masuda, Akashi (JP); Yoshihiko Inagaki, Kakogawa (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 0 days.

(21) Appl. No.: 14/664,649

(22) Filed: Mar. 20, 2015

(65) Prior Publication Data

US 2015/0275740 A1 Oct. 1, 2015

(30) Foreign Application Priority Data

Mar. 26, 2014 (JP) ..... 2014-064025

(51) Int. Cl.

| | |
|---|---|
| ***F01N 1/08*** | (2006.01) |
| ***F01N 1/12*** | (2006.01) |
| ***F01N 1/02*** | (2006.01) |
| ***F01N 13/18*** | (2010.01) |
| ***F01N 1/04*** | (2006.01) |
| ***F01N 1/24*** | (2006.01) |

(52) U.S. Cl.

CPC *F01N 1/026* (2013.01); *F01N 1/04* (2013.01); *F01N 1/24* (2013.01); *F01N 13/1872* (2013.01); *F01N 2470/02* (2013.01); *F01N 2590/04* (2013.01)

(58) Field of Classification Search

CPC ..... F01N 1/086; F01N 1/088; F01N 1/12; F01N 1/125; F01N 2470/08

USPC ..... 181/248, 249, 250, 252, 256, 258, 279, 181/280

See application file for complete search history.

(56) References Cited

U.S. PATENT DOCUMENTS

| | | | | | |
|---|---|---|---|---|---|
| 1,515,463 | A * | 11/1924 | De Lancey | F01N 1/08 | 181/269 |
| 3,235,003 | A * | 2/1966 | Smith | F01N 1/125 | 138/38 |
| 3,696,883 | A * | 10/1972 | Devane | F01N 1/125 | 181/280 |
| 3,746,126 | A * | 7/1973 | de Cardenas | F01N 1/12 | 138/37 |
| 4,050,539 | A * | 9/1977 | Kashiwara | F01N 1/06 | 181/228 |
| 4,667,770 | A * | 5/1987 | DeVane | F24F 13/24 | 181/243 |
| 6,089,348 | A * | 7/2000 | Bokor | F01N 1/003 | 181/255 |
| 6,571,910 | B2 * | 6/2003 | Storm | F01N 1/04 | 181/249 |
| 7,971,682 | B2 * | 7/2011 | Inoue | F01N 1/04 | 181/212 |
| 8,312,962 | B2 * | 11/2012 | Melcher | F01N 1/081 | 181/212 |
| 2002/0185334 | A1 * | 12/2002 | Kim | F01N 1/006 | 181/279 |

(Continued)

FOREIGN PATENT DOCUMENTS

JP 2011247161 A 12/2011

*Primary Examiner* — Jeremy Luks

(74) *Attorney, Agent, or Firm* — Alleman Hall McCoy Russell & Tuttle LLP

(57) ABSTRACT

An exhaust apparatus includes: an inner tube including therein an exhaust passage and also including a peripheral wall portion on which a plurality of opening portions communicating with the exhaust passage are formed; an outer tube accommodating the inner tube, an internal space being formed between the outer tube and an outer periphery of the inner tube; and a flow rectifying member arranged at a region inside the inner tube, having a spiral shape in an axial direction of the inner tube, and configured to rectify an exhaust gas flowing through the exhaust passage.

7 Claims, 6 Drawing Sheets

(56) References Cited

U.S. PATENT DOCUMENTS

2005/0076668 A1* 4/2005 Choi ..... B60H 1/00564 62/404
2005/0205353 A1* 9/2005 Chen ..... F01N 1/086 181/270
2005/0284692 A1* 12/2005 McWilliam ..... F02M 35/1211 181/258
2009/0283358 A1* 11/2009 Hughey ..... F01N 1/08 181/264

* cited by examiner

EXHAUST APPARATUS

BACKGROUND OF THE INVENTION

1. Field of the Invention

The present invention relates to an exhaust apparatus.

2. Description of the Related Art

As disclosed in, for example, Japanese Laid-Open Patent Application Publication No. 2011-247161, an exhaust apparatus mounted on a motorcycle or the like includes: an exhaust pipe connected to a downstream side of an exhaust port of an engine; an inner tube whose upstream end portion is connected to the exhaust pipe and whose peripheral wall portion is provided with a plurality of opening portions; an outer tube accommodating the inner tube so as to cover an outer periphery of the inner tube; a sound absorbing material arranged in a space located between the inner tube and the outer tube; a tail pipe connected to a downstream end portion of the inner tube; and an end cone covering the tail pipe.

While the engine is operating, an exhaust gas flows through an exhaust passage, constituted by the insides of the exhaust pipe, the inner tube, and the tail pipe, to be discharged outside. At this time, the exhaust gas flows through the opening portions of the peripheral wall portion of the inner tube to flow through the inside of the sound absorbing material. Thus, exhaust sound is reduced. With this, the exhaust apparatus achieves a silencing effect of the exhaust sound.

According to the exhaust apparatus configured as above, the exhaust gas is introduced to the sound absorbing material arranged in an internal space located between the outer tube and the inner tube. With this, a certain degree of silencing effect of the exhaust sound is obtained. However, a higher silencing effect is desired. In addition to the high silencing effect, satisfactorily maintaining an exhaust efficiency of the exhaust gas in the exhaust apparatus is also desired.

The present invention was made in light of the above problems, and an object of the present invention is to provide an exhaust apparatus having a relatively simple configuration but capable of achieving an excellent silencing effect while maintaining a satisfactory exhaust efficiency of an exhaust gas.

SUMMARY OF THE INVENTION

To solve the above problems, an exhaust apparatus according to one aspect of the present invention includes: an inner tube including therein an exhaust passage and also including a peripheral wall portion on which a plurality of opening portions communicating with the exhaust passage are formed; an outer tube accommodating the inner tube, an internal space being formed between the outer tube and an outer periphery of the inner tube; and a flow rectifying member arranged at a region inside the inner tube, facing the exhaust passage, having a spiral shape in an axial direction of the inner tube, and configured to rectify an exhaust gas flowing through the exhaust passage.

In the exhaust apparatus according to the aspect of the present invention configured as above, the flow rectifying member configured to rectify the exhaust gas flowing through the exhaust passage of the inner tube is formed in a spiral shape in the axial direction of the inner tube. Therefore, when the exhaust gas flows through the exhaust passage of the inner tube, the exhaust gas is rotated in a spiral manner around the axis of the inner tube by the flow rectifying member and flows toward the downstream side of the exhaust passage while swirling and being rectified. At this time, inertial force acts on the exhaust gas, so that the exhaust gas is discharged outside from the inner tube while being rotated in a spiral manner.

At this time, in the inner tube, the exhaust gas flowing through the exhaust passage contacts the flow rectifying member. With this, the flow of the exhaust gas is changed. Thus, the exhaust gas can be introduced through the opening portions of the inner tube to the internal space located between the outer tube and the inner tube. In a case where the sound absorbing material is arranged in the internal space in advance, the sound of the exhaust gas is efficiently absorbed by the sound absorbing material. With this, the exhaust sound can be satisfactorily reduced. Or, by expanding the exhaust gas in the internal space, the exhaust sound can be satisfactorily reduced.

Further, the exhaust apparatus according to the aspect of the present invention has a relatively simple configuration in which: the outer tube includes therein the internal space and accommodates the inner tube; and the flow rectifying member having a spiral shape in the axial direction of the inner tube is arranged in the exhaust passage of the inner tube. Therefore, the exhaust gas according to the aspect of the present invention can be manufactured more easily than the exhaust apparatus having a complex configuration.

The flow rectifying member has a spiral shape in the axial direction of the inner tube and is arranged in the exhaust passage of the inner tube. Therefore, a ratio of the area occupied by the flow rectifying member to the cross-sectional area of the exhaust passage of the inner tube in a cross-sectional direction of the inner tube can be suppressed to a low level. On this account, even in a case where the flow rectifying member is arranged inside the inner tube, the flow of the exhaust gas is hardly interfered, so that the exhaust efficiency of the exhaust apparatus can be satisfactorily maintained.

As a result, the present invention can provide the exhaust apparatus which is relatively simple in configuration but can achieve the excellent silencing effect while maintaining the satisfactory exhaust efficiency of the exhaust gas.

DESCRIPTION OF THE PREFERRED EMBODIMENTS

Hereinafter, embodiments of the present invention will be explained in reference to the drawings.

Embodiment 1

Figure 1:
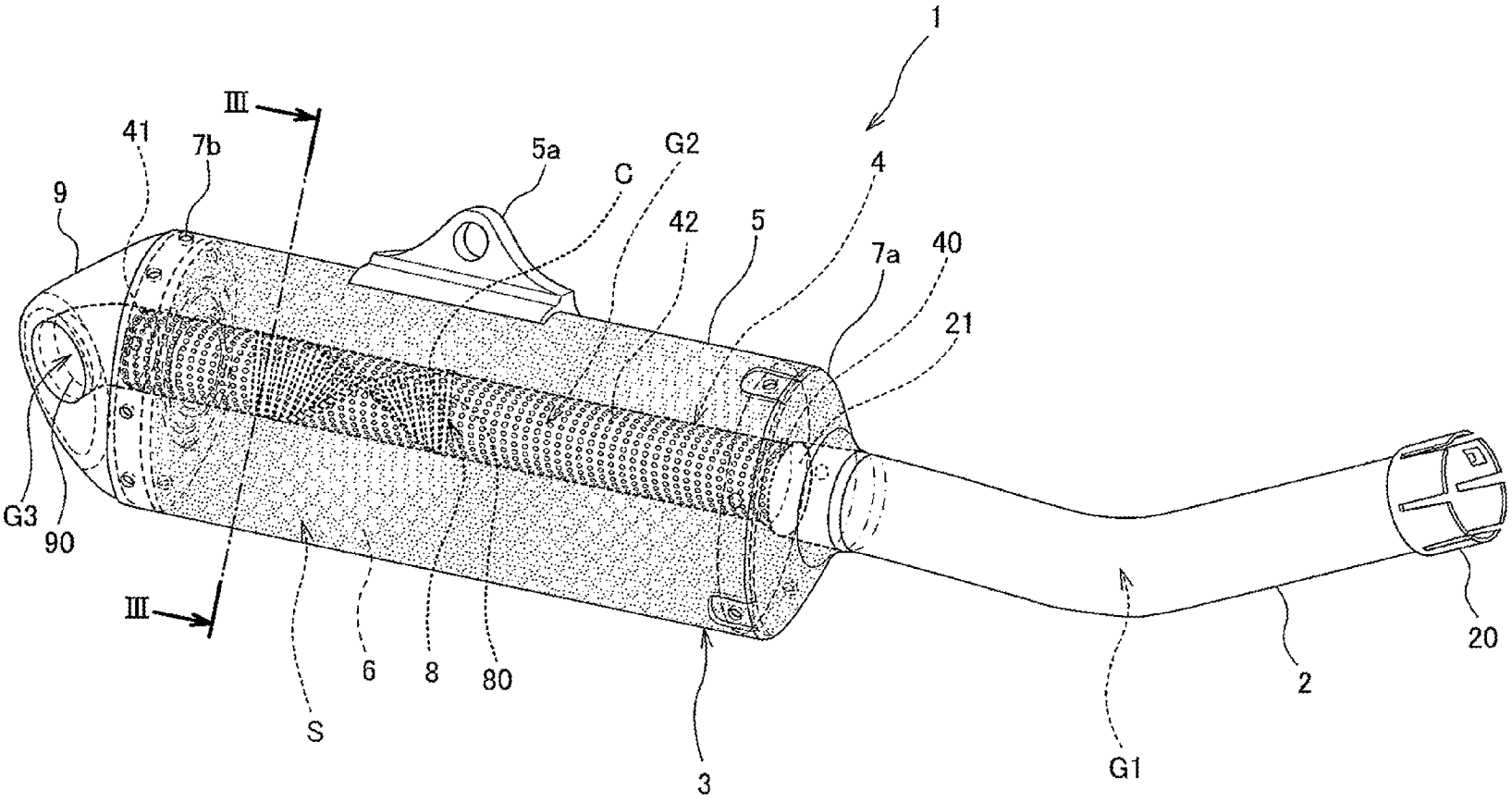
FIG. 1 is a partially transparent view showing the configuration of an exhaust apparatus according to Embodiment 1.
Figure 2:
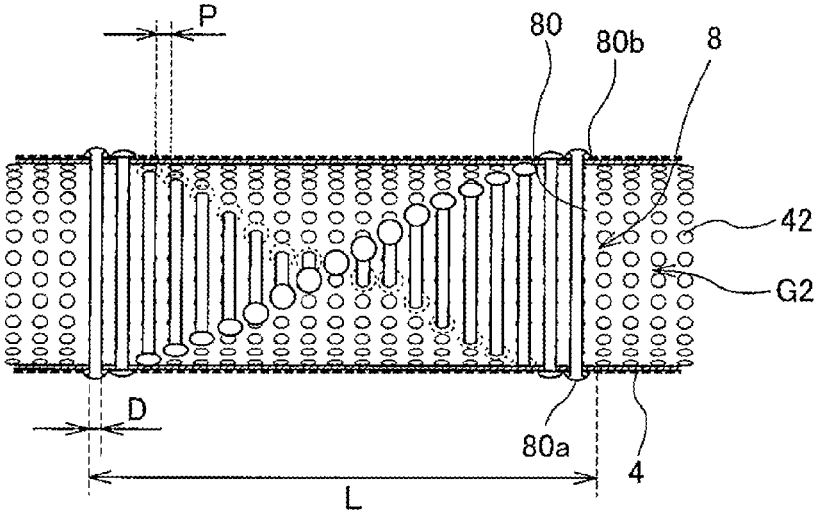
FIG. 2 is a partially cross-sectional view showing the structure of an inner tube.
Figure 3:
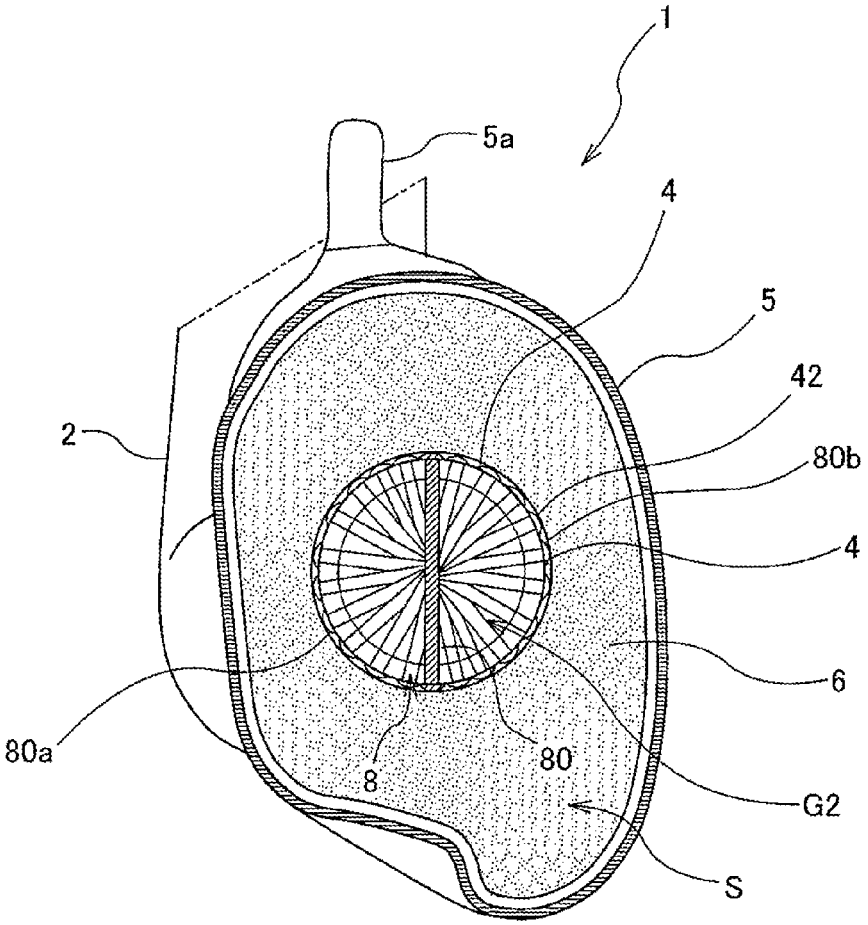
FIG. 3 is a cross-sectional view taken along line III-III of FIG. 1 showing the exhaust apparatus.

Each of FIGS. 1 to 3 shows the configuration of an exhaust apparatus 1 according to Embodiment 1. In FIG. 1, internal structures of an outer tube 5 and an end cone 9 are shown by dotted lines.

The exhaust apparatus 1 has a so-called straight exhaust type configuration and includes an exhaust pipe 2 and a columnar apparatus main body 3 coupled to the exhaust pipe 2.

An upstream end 20 of the exhaust pipe 2 is connected to, for example, an exhaust passage of an engine mounted on a motorcycle. A downstream end 21 of the exhaust pipe 2 is connected to an inner tube 4 of the apparatus main body 3. An exhaust passage G1 through which an exhaust gas flows is formed in the exhaust pipe 2 and communicates with an exhaust passage G2 of the inner tube 4. As shown in FIG. 1, the exhaust pipe 2 is gently bent and formed in a bent pipe shape so as to correspond to the shape of the motorcycle. The exhaust pipe 2 is made of, for example, a stainless steel material.

The apparatus main body 3 includes: the inner tube 4 connected to the exhaust pipe 2; the outer tube 5 accommodating the inner tube 4 along an axial direction thereof; a sound absorbing material 6 arranged in an annular internal space S located between an outer periphery of a peripheral wall portion of the inner tube 4 and an inner periphery of the outer tube 5; a pair of plate members 7*a* and 7*b* respectively arranged at both ends of the outer tube 5; a flow rectifying member 8 arranged inside the inner tube 4; and the end cone 9 arranged at the plate member 7*b* side of the outer tube 5. The inner tube 4, the outer tube 5, the plate members 7*a* and 7*b*, the flow rectifying member 8, and the end cone 9 are made of, for example, a stainless steel material, as the exhaust pipe 2 is.

The outer tube 5 is formed in a substantially cylindrical shape and serves as an exterior of the apparatus main body 3. A bracket 5*a* for attaching the exhaust apparatus 1 to the motorcycle is arranged at an outer periphery of a peripheral wall portion of the outer tube 5. The outer tube 5 accommodates the inner tube 4 while forming the certain internal space (silencing space) S located between the outer periphery of the peripheral wall portion of the inner tube 4 and the inner periphery of the outer tube 5. In this case, the inner tube 4 and the outer tube 5 are arranged such that respective axes thereof substantially coincide with each other. The plate member 7*a* is arranged at an upstream end portion of the outer tube 5, and the plate member 7*b* is arranged at a downstream end portion of the outer tube 5. In this manner, the internal space S is closed inside the outer tube 5. The outer tube 5 is a substantially cylindrical body as one example but is not limited to this. For example, the outer tube 5 may be a triangular cylindrical body, a polygonal cylindrical body, an oval cylindrical body, or the like.

As one example, the sound absorbing material 6 is constituted by: fiber made of an inorganic material having heat resistance; or a sponge-like filler. Specific examples of the fiber include glass wool and steel wool. As shown in FIGS. 1 and 3, the sound absorbing material 6 fills the entire internal space S and an internal space located between the inner tube 4 and the plate member 7*a* in the apparatus main body 3. However, the sound absorbing material 6 may instead be provided only in a part (for example, a position close to opening portions 42) of the internal space S. Further, the sound absorbing material 6 may be constituted by stacking plural types of wool on the outer periphery of the inner tube 4.

The inner tube 4 is a tubular body having a straight pipe shape, and a plurality of opening portions 42 which are each the same in shape and inner diameter as one another, are formed on the peripheral wall portion of the inner tube 4. The inner tube 4 is a cylindrical body as one example but is not limited to this. For example, the inner tube 4 may be a triangular cylindrical body, a polygonal cylindrical body, an oval cylindrical body, or the like, as with the outer tube 5.

The inner tube 4 includes therein the exhaust passage G2. In the apparatus main body 3, the exhaust passage G2 communicates with the internal space S through the opening portions 42. For example, the inner tube 4 can be manufactured by processing a punched member into a tubular shape, the punched member being formed by using a stainless steel plate. Each of the opening portions 42 is formed to have a circular peripheral edge shape. The opening portions 42 are arranged in a zigzag in the axial direction of the inner tube 4. The inner tube 4 may be constituted by a wire mesh. The peripheral edge shape of each opening portion 42 may be a rectangular shape, a polygonal shape, a curved shape, or a slit shape. The inner diameters of the opening portions 42 may be adjusted so as to be different from one another at various portions of the inner tube 4. Further, the arrangement of the opening portions 42 is not limited. For example, the opening portions 42 may be randomly arranged on the peripheral wall portion of the inner tube 4 or may be arranged in a lattice pattern in the axial direction and circumferential direction of the inner tube 4. As a matter of convenience, FIG. 1 shows the plurality of opening portions 42 only in an upstream part of the peripheral wall portion of the inner tube 4. However, the plurality of opening portions 42 are actually formed on the entire inner tube 4. In addition, FIG. 1 shows the appearance and shape of a portion close to the end portion 40 of the inner tube 4.

The shape of the inner tube 4 is not limited to the straight pipe shape and may be a bent pipe shape. As disclosed in Japanese Laid-Open Patent Application Publication No. 2011-247161, a depressed portion may be formed on the peripheral wall portion of the inner tube 4 by partially depressing the peripheral wall portion of the inner tube 4 inward. With this configuration, the exhaust gas flowing through the exhaust passage G2 contacts the depressed portion of the inner tube 4 and is introduced to the inside of the sound absorbing material 6 through the opening portions 42 of the depressed portion. Thus, the silencing effect by the sound absorbing material 6 can be further increased.

The flow rectifying member 8 is arranged at a region in the inner tube 4 in order to rectify the exhaust gas flowing through the exhaust passage G2. Therefore, the flow rectifying member 8 is arranged so as to cross the inside of the inner tube 4 in a radial direction of the inner tube 4 and has a spiral shape in the axial direction of the inner tube 4. Specifically, the flow rectifying member 8 is constituted by a plurality of pins 80 which are coupled to the peripheral wall portion of the inner tube 4 at a downstream region of the exhaust passage G2 and are spaced apart from one another in the axial direction of the inner tube 4. Specifically, as shown in FIGS. 1 and 2, the plurality of pins 80 of the flow rectifying member 8 are arranged so as to cross the inside of the inner tube 4 in the radial direction. In addition, as shown in FIG. 3, the adjacent pins 80 are respectively arranged at positions displaced from each other at a predetermined angle around the axis of the inner tube 4. With this, the flow rectifying member 8 is configured to have a long shape formed in a spiral shape in the axial direction of the inner tube 4 as a whole. Regarding the radial direction of the inner tube 4, the flow rectifying member 8 is configured so as to only have a thickness corresponding to the diameter of a single pin 80. With this, even in a case where the flow rectifying member 8 is arranged inside the inner tube 4, the cross-sectional area of the exhaust passage G2 decreases little by the area occupied by the flow rectifying member 8. As a matter of convenience, FIG. 2 shows the cross-sectional shape of the inner tube 4 and the appearance shape of the flow rectifying member 8.

As one example, each of the pins 80 is a shaft body having a circular cross section, and at least one of end portions 80*a* and 80*b* of the pin 80 is coupled to the peripheral wall portion of the inner tube 4. Diameters D of the pins 80 and pitches P each between the adjacent two pins 80 are suitably adjustable. For example, each of the diameters D and the pitches P can be set to about several millimeters. As one example, the diameter D of the pin 80 may be set to 5 mm, and the pitch P between the adjacent two pins 80 may be set to 7 mm. When the diameter D of the pin 80 is small, a wide exhaust passage G2 can be secured, which is desirable. The pin 80 is the shaft body having the circular cross section as one example. However, the shape of the pin 80 is not limited to the shape having the circular cross section. For example, the pins 80 may be prismatic bodies having rectangular cross sections or polygonal prismatic bodies having polygonal cross sections. The end portions 80*a* and 80*b* of the pins 80 do not have to be coupled to the peripheral wall portion of the inner tube 4. One of the end portions 80*a* and 80*b* may be arranged in the exhaust passage G2. The diameters of the pins 80 do not have to be equal to one another and may be different from one another. The diameters of the pins 80 may change along an axial direction of the pins 80. Specifically, the pins 80 can be configured as a shaft body having a conical shape or a polygonal pyramid shape.

The degree of the spiral of the flow rectifying member 8 is suitably adjustable. For example, the degree of the spiral of the flow rectifying member 8 can be set within a range of not less than one half of one turn (360 degrees) around the axis of the inner tube 4 and not more than three fourths of one turn (360 degrees) around the axis of the inner tube 4. In other words, as shown in FIG. 3, when viewed from a cross-sectional direction of the inner tube 4, an angle between the pin 80 located at one end portion of the flow rectifying member 8 in the axial direction of the inner tube 4 and the pin 80 located at the other end portion the flow rectifying member 8 in the axial direction of the inner tube 4 can be set within a range of not less than 180 degrees and not more than 270 degrees.

In order to obtain a satisfactory exhaust gas rectifying effect, it is desirable that the flow rectifying member 8 be arranged in the inner tube 4 so as to be located at a position at least upstream of a middle portion of the exhaust passage G2 of the inner tube 4. Specifically, as shown in FIG. 1, in order to obtain the exhaust gas rectifying effect, it is preferable to arrange the flow rectifying member 8 at a position upstream of a middle portion C of the exhaust passage G2 in the axial direction of the inner tube 4. In order to efficiently introduce the exhaust gas to the internal space S through the opening portions 42 of the inner tube 4, it is desirable that the flow rectifying member 8 be arranged in the inner tube 4 so as to overlap a wide region of the exhaust passage G2 in the axial direction of the inner tube 4. Specifically, as shown in FIG. 1, in a case where the flow rectifying member 8 is arranged at a position overlapping the middle portion C of the exhaust passage G2 in the axial direction of the inner tube 4 or at a position upstream of the middle portion C in the axial direction of the inner tube 4, the exhaust gas flowing through the exhaust passage G2 is efficiently introduced to the internal space S at a relatively early stage, so that opportunities of causing the exhaust gas to contact the sound absorbing material 6 can be increased, which is preferable. Therefore, as shown in FIG. 2, as one example, a length L of the flow rectifying member 8 can be adjusted such that the flow rectifying member 8 overlaps the middle portion C of the exhaust passage G2 in the axial direction of the inner tube 4 and extends toward a downstream side of the middle portion C to have a certain length. Specifically, for example, the length L of the flow rectifying member 8 can be set within a range of not less than one third of an axial length of the inner tube 4 and not more than one half of the axial length of the inner tube 4. Or, the flow rectifying member 8 may be arranged inside the entire inner tube 4. In this case, the exhaust gas can be rectified over the entire exhaust passage G2, and the exhaust gas can be efficiently introduced to the inside of the sound absorbing material 6 through the opening portions 42 over the entire inner tube 4.

The end cone 9 includes therein a tail pipe 90 and is fixed to the plate member 7*b* and the outer tube 5 such that the tail pipe 90 is connected to a downstream end portion 41 of the inner tube 4. The tail pipe 90 includes therein an exhaust passage G3 and is continuous with the exhaust passage G2 of the inner tube 4. The tail pipe 90 has a bent pipe shape, and a downstream opening of the exhaust passage G3 is oriented in a predetermined direction.

According to the exhaust apparatus 1 configured as above, when the exhaust gas is discharged from the engine of the motorcycle in accordance with the operation of the engine, the exhaust gas flows through the exhaust passage G1 of the exhaust pipe 2 to flow through the exhaust passage G2 of the inner tube 4. After that, the exhaust gas flows through the exhaust passage G3 of the tail pipe 90 to be discharged to the outside.

In the exhaust apparatus 1, the flow rectifying member 8 configured to rectify the exhaust gas flowing through the exhaust passage G2 of the inner tube 4 is formed in a spiral shape in the axial direction of the inner tube 4. Therefore, when the exhaust gas flows through the exhaust passage G2 of the inner tube 4, the exhaust gas is rotated in a spiral manner around the axis of the inner tube 4 by the flow rectifying member 8 and flows toward the downstream side of the exhaust passage G2 while swirling and being rectified. At this time, inertial force acts on the exhaust gas, so that the exhaust gas is discharged from the inner tube 4 to the outside while being rotated in a spiral manner. At this time, in the inner tube 4 of the exhaust apparatus 1, the exhaust gas flowing through the exhaust passage G2 contacts side portions of the pins 80 of the flow rectifying member 8. With this, the exhaust gas can be efficiently introduced through the opening portions 42 of the inner tube 4 to the internal space S located between the outer tube 5 and the inner tube 4. In the exhaust apparatus 1, since the internal space S is filled with the sound absorbing material 6, the exhaust sound can be satisfactorily reduced by efficiently introducing the exhaust gas to the inside of the sound absorbing material 6. With this, even the exhaust gas flowing straight toward the downstream side of the exhaust passage G2 can be efficiently introduced to the sound absorbing material 6. As a result, the excellent silencing effect by the sound absorbing material 6 can be achieved. After the exhaust gas flows through narrow gaps between each adjacent pin 80, the exhaust gas expands drastically. Therefore, the satisfactory silencing effect can be achieved.

The exhaust apparatus 1 has a relatively simple configuration in which: the outer tube 5 includes therein the internal space S and accommodates the inner tube 4; and the flow rectifying member 8 having a spiral shape in the axial direction of the inner tube 4 is arranged in the exhaust passage G2 of the inner tube 4. Therefore, the exhaust apparatus 1 can be manufactured relatively easily.

Further, the thickness of the flow rectifying member 8 in the radial direction of the inner tube 4 is only the diameter of the single pin 80. Therefore, as shown in FIG. 3, a ratio of the area occupied by the flow rectifying member 8 to the cross-sectional area of the exhaust passage G2 in the radial direction of the inner tube 4 is considerably suppressed. On this account, even in a case where the flow rectifying member 8 is arranged inside the inner tube 4, the flow of the exhaust gas in the exhaust passage G2 is hardly impaired, so that the exhaust efficiency can be maintained satisfactorily.

As a result, Embodiment 1 can provide the exhaust apparatus 1 which is relatively simple in configuration but can achieve the excellent silencing effect while maintaining the satisfactory exhaust efficiency of the exhaust gas.

Hereinafter, differences between Embodiment 1 and each of the other embodiments of the present invention will be mainly explained.

Embodiment 2

Figure 4:
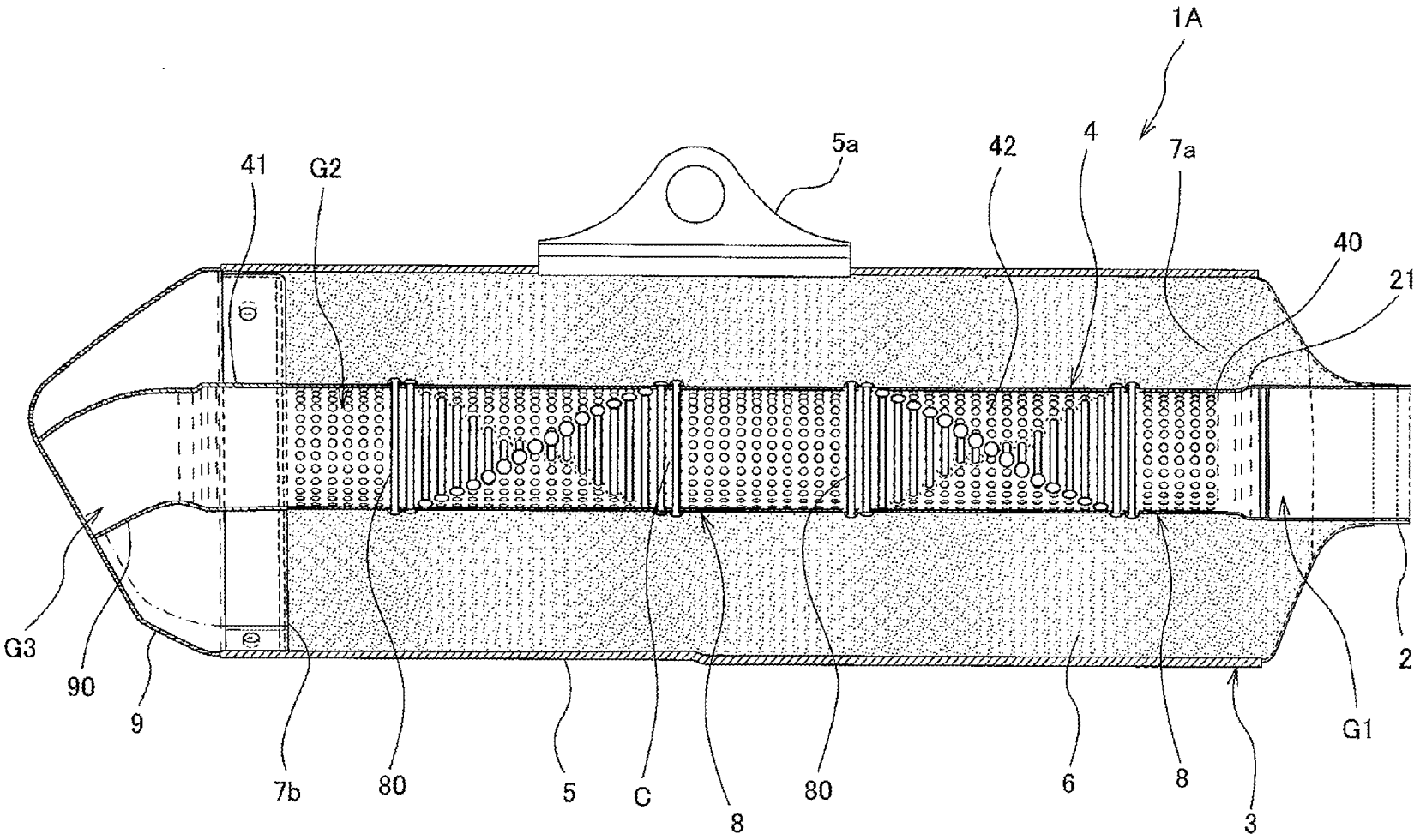
FIG. 4 is a partially cross-sectional view showing the configuration of the exhaust apparatus according to Embodiment 2.

FIG. 4 is a partially cross-sectional view showing the configuration of an exhaust apparatus 1A according to Embodiment 2. As shown in FIG. 4, in the inner tube 4 of the exhaust apparatus 1A, the flow rectifying members 8 are respectively arranged at regions of the exhaust passage G2 which are different from each other in the axial direction of the inner tube 4. Specifically, the flow rectifying members 8 are respectively arranged at two regions that are a region upstream of the middle portion C of the exhaust passage G2 in the axial direction of the inner tube 4 and a region downstream of the middle portion C of the exhaust passage G2 in the axial direction of the inner tube 4. FIG. 4 shows appearance shapes of the flow rectifying members 8.

According to this configuration, by using the two flow rectifying members 8 arranged at different positions in the inner tube 4, the exhaust gas flowing through the exhaust passage G2 can be further satisfactorily rotated and rectified in a spiral manner. Thus, the silencing effect of the exhaust sound is further satisfactorily obtained. The exhaust gas contacts the flow rectifying member 8 at an early stage at an upstream region of the exhaust passage G2. In addition, the sound absorbing material 6 arranged in the internal space S is effectively utilized, and the exhaust gas is efficiently introduced to the inside of the sound absorbing material 6. With this, the exhaust sound can be reduced. Therefore, the excellent silencing effect of the exhaust sound is obtained.

Embodiment 3

Figure 5:
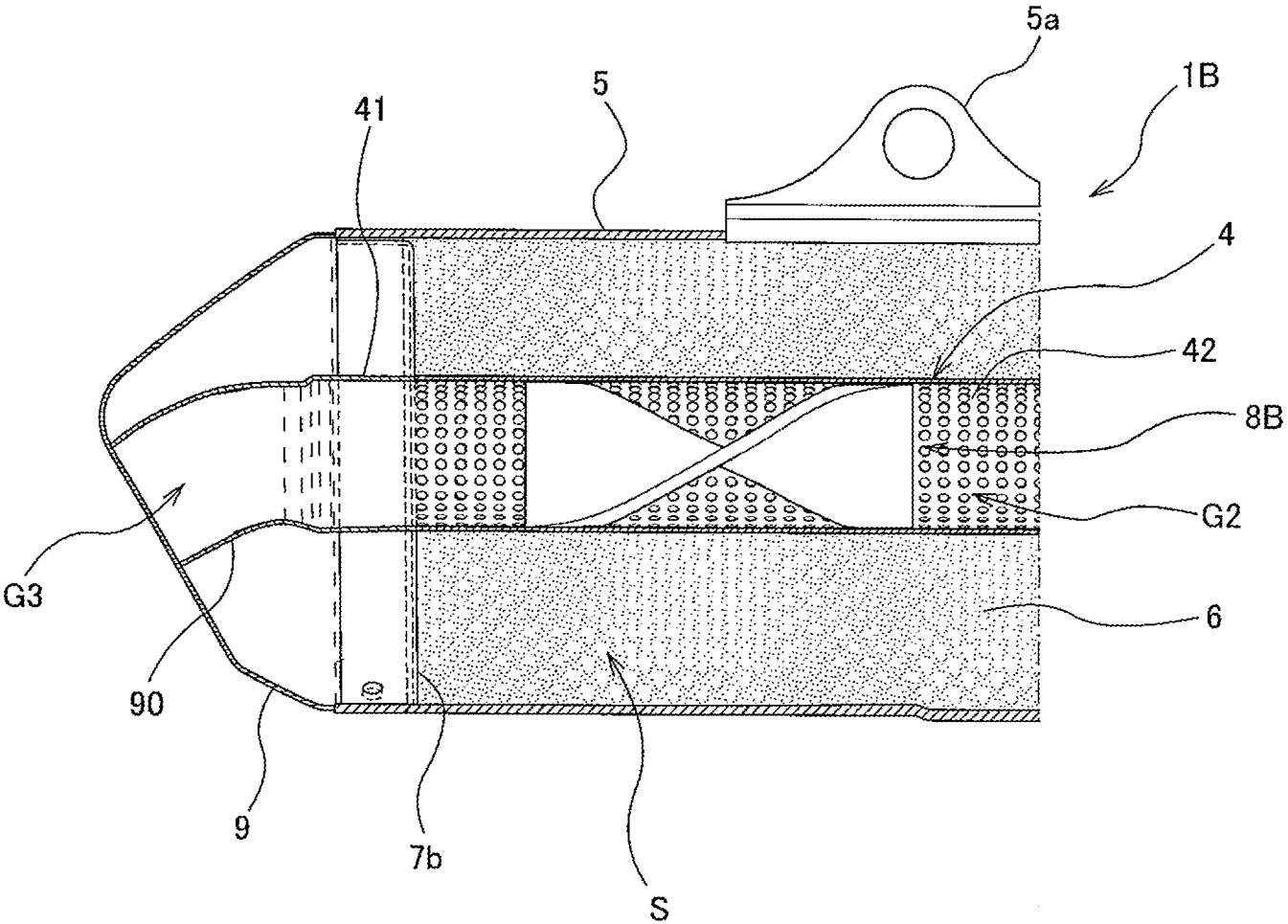
FIG. 5 is a partially cross-sectional view showing the configuration of the exhaust apparatus according to Embodiment 3.

FIG. 5 is a partially cross-sectional view showing the configuration of an exhaust apparatus 1B according to Embodiment 3. A flow rectifying member 8B used in the exhaust apparatus 1B is configured by processing a plate-shaped member into a spiral shape and has a smooth surface. The exhaust apparatus 1B uses the flow rectifying member 8B configured as above. The flow rectifying member 8B is arranged in the inner tube 4 and is fixed to the inner tube 4. FIG. 5 shows an appearance and shape of the flow rectifying member 8B.

According to this configuration, by using the flow rectifying member 8B having the smooth surface, the exhaust gas flowing through the exhaust passage G2 can be smoothly rotated and rectified in a spiral manner along the flow rectifying member 8B. Therefore, as with Embodiment 1, the achievement of the high silencing effect can be expected. In addition, since the exhaust gas contacts a large surface area of the flow rectifying member 8B, the exhaust gas can be efficiently introduced to the inside of the sound absorbing material 6 of the internal space S through the opening portions 42. Therefore, the high silencing effect of the exhaust sound by the sound absorbing material 6 can be expected.

Embodiment 4

Figure 6:
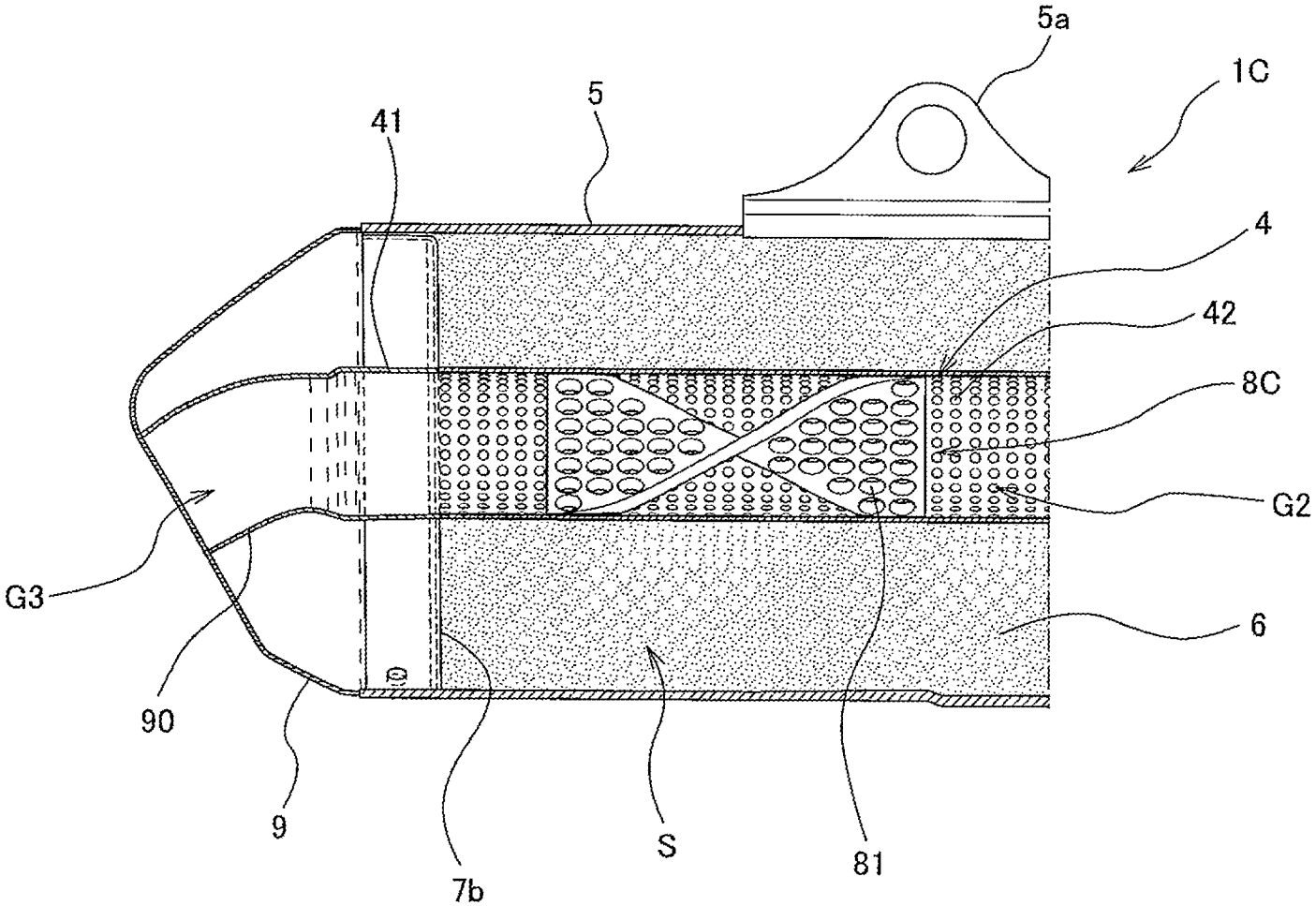
FIG. 6 is a partially cross-sectional view showing the configuration of the exhaust apparatus according to Embodiment 4.

FIG. 6 is a partially cross-sectional view showing the configuration of an exhaust apparatus 1C according to Embodiment 4. The exhaust apparatus 1C uses a flow rectifying member 8C configured by processing a plate-shaped member into a spiral shape, the plate-shaped member having a surface on which a large number of opening portions 81 are formed. The flow rectifying member 8C is arranged in the inner tube 4 and is fixed to the inner tube 4. For example, a punching member formed by using a stainless steel plate can be utilized as a material of the flow rectifying member 8C. FIG. 6 shows an appearance and shape of the flow rectifying member 8C.

According to this configuration, by using the flow rectifying member 8C having a plate shape as a whole, the exhaust gas flowing through the exhaust passage G2 can be smoothly rotated and rectified in a spiral manner along the flow rectifying member 8C. Therefore, as with Embodiment 3, the achievement of the high silencing effect can be expected. In addition, since the exhaust gas contacts the large surface area of the flow rectifying member 8C, the exhaust gas can be efficiently introduced to the inside of the sound absorbing material 6 of the internal space S through the opening portions 42. Therefore, the high silencing effect of the exhaust sound by the sound absorbing material 6 can be expected. Further, the exhaust gas flowing through the exhaust passage G2 can flow along both surfaces of the flow rectifying member 8C through a large number of opening portions 81. Therefore, an effect of causing the exhaust gas to flow in the thickness direction of the flow rectifying member 8C and plentifully introducing the exhaust gas to the inside of the sound absorbing material 6 through the opening portions 42 of the inner tube 4 can be expected.

Embodiment 5

Figure 7:
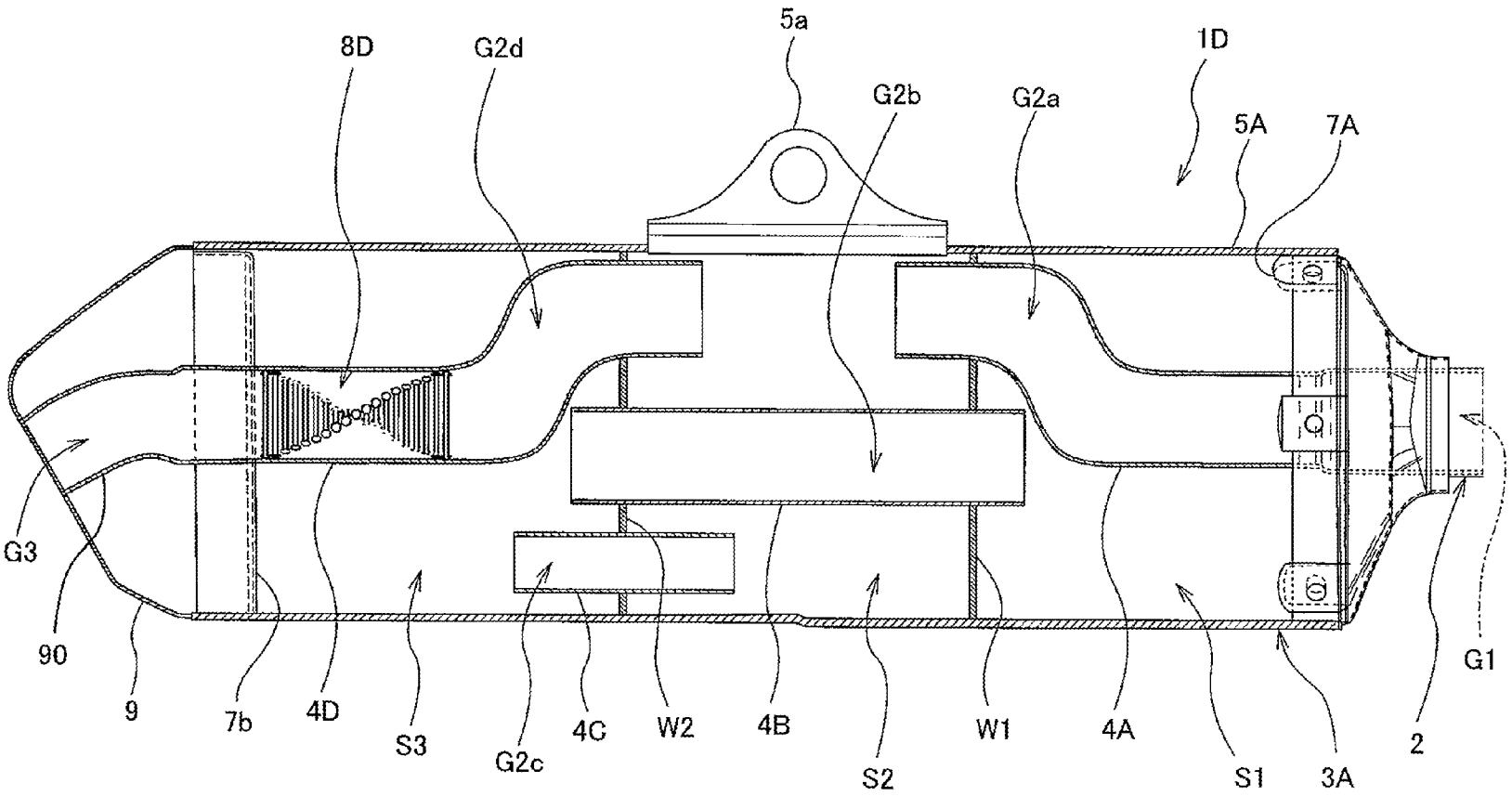
FIG. 7 is a partially cross-sectional view showing the configuration of the exhaust apparatus according to Embodiment 5.

FIG. 7 is a partially cross-sectional view showing the configuration of an exhaust apparatus 1D according to Embodiment 5. The exhaust apparatus 1D has a so-called multistage expansion type configuration and includes two wall portions W1 and W2 which define the middle of an outer tube 5A of an apparatus main body 3A in the axial direction. With this, internal spaces S1 to S3 are defined in this order from the front side to rear side of the apparatus main body 3A.

In addition, the exhaust apparatus 1D includes inner tubes 4A to 4D arranged inside the apparatus main body 3A. One end of the inner tube 4A is connected to the exhaust pipe 2, and the other end thereof is open to the internal space S2. A peripheral wall portion of the inner tube 4B is supported by the wall portions W1 and W2. One end of the inner tube 4B is open to the internal space S1, and the other end thereof is open to the internal space S3. A peripheral wall portion of the inner tube 4C is supported by the wall portion W2. One end of the inner tube 4C is open to the internal space S2, and the other end thereof is open to the internal space S3. Further, the inner tube 4D is located at a most downstream side in the exhaust passage of the apparatus main body 3A. One end of the inner tube 4D is open to the internal space S2, and the other end thereof is connected to the tail pipe 90. The inner tubes 4A to 4D respectively include therein exhaust passages G2*a* to G2*d*. As above, the inner tubes 4A to 4D and the internal spaces S1 to S3 are arranged at predetermined positions in the apparatus main body 3A. With this, the entire length of the exhaust passage becomes longer than the entire length of the apparatus main body 3. A flow rectifying member 8D having the same configuration as the flow rectifying member 8 of Embodiment 1 is arranged inside the inner tube 4D. FIG. 7 shows an appearance shape of the flow rectifying member 8D.

According to the exhaust apparatus 1D configured as above, the exhaust gas having flowed from the exhaust pipe 2 through the exhaust passage G2*a* expands drastically in the internal space S2. With this, the silencing effect of the exhaust sound is obtained. Similarly, the exhaust gas having flowed from the internal space S2 through the exhaust passage G2*c* expands drastically in the internal space S3. With this, the increased silencing effect of the exhaust sound is obtained. Further, the exhaust gas having flowed from the internal space S3 through the exhaust passage G2*b* expands drastically in the internal space S1. With this, the further increased silencing effect of the exhaust sound is obtained.

The exhaust gas having flowed from the internal space S2 into the exhaust passage G2*d* is finally rotated and rectified in a spiral manner by the flow rectifying member 8D to be discharged to the outside through the exhaust passage G3 of the tail pipe 90. Therefore, as with Embodiment 1, the exhaust gas is discharged to the outside while being rotated in a spiral manner. On this account, the satisfactory silencing effect of the exhaust sound is achieved.

Even though the flow rectifying member 8D is arranged inside the inner tube 4D, the exhaust efficiency of the exhaust passage G2*d* in a radial cross section of the inner tube 4D is satisfactorily maintained. Therefore, the exhaust efficiency of the entire exhaust apparatus 1D can be satisfactorily maintained.

Other Matters

The exhaust apparatus of the present invention can be utilized by not only motorcycles but also various vehicles (such as three-wheeled vehicles and four-wheeled vehicles), ships, aircrafts, and the like. Further, the exhaust apparatus of the present invention is applicable to stationary and portable engines.

The "spiral shape" used when mentioning the shape of the flow rectifying member of the present invention denotes not only a spiral shape that is mathematically strictly defined but also a spiral shape that has a slight distortion. Therefore, in Embodiments 1 and 2, for example, each of the plurality of pins 80 constituting the flow rectifying member 8 does not have to be a straight shaft body, and at least one of the pins 80 may be bent slightly. Or, the angles each between the adjacent pins 80 arranged in the inner tube 4 when viewed from the axial direction of the inner tube 4 do not have to be equal to one another and may be slightly different from one another. In other words, the pitches P each between the adjacent pins 80 of the flow rectifying member 8 do not have to be equal to one another and may be different from one another at various regions of the inner tube 4 or may be at random.

As above, the exhaust apparatus according to the present invention has an excellent effect of being relatively simple in configuration but also being able to achieve the excellent silencing effect while maintaining the satisfactory exhaust efficiency of the exhaust gas. Therefore, it is useful to widely apply the exhaust apparatus according to the present invention as the exhaust apparatus which can achieve the significance of this effect.

As this invention may be embodied in several forms without departing from the spirit of essential characteristics thereof, the present embodiments are therefore illustrative and not restrictive, since the scope of the invention is defined by the appended claims rather than by the description preceding them. All changes that fall within the metes and bounds of the claims, or equivalence of such metes and bounds thereof, are therefore intended to be embraced by the claims.

What is claimed is:

1. An exhaust apparatus comprising:

an inner tube including therein an exhaust passage and also including a peripheral wall portion on which a plurality of opening portions communicating with the exhaust passage are formed;

an outer tube accommodating the inner tube, an internal space being formed between the outer tube and an outer periphery of the inner tube; and a flow rectifying member arranged at a region inside the inner tube, having a spiral shape in an axial direction of the inner tube, and configured to rectify an exhaust gas flowing through the exhaust passage, wherein the flow rectifying member is completely constituted by a plurality of pins coupled to the peripheral wall portion of the inner tube and spaced apart from one another in the axial direction of the inner tube.

2. The exhaust apparatus according to claim 1, wherein the flow rectifying member is provided at a position at least downstream of a middle portion of the exhaust passage of the inner tube.

3. The exhaust apparatus according to claim 1, wherein the flow rectifying member is provided so as to cross an inside of the inner tube in a radial direction of the inner tube.

4. The exhaust apparatus according to claim 1, wherein the flow rectifying member is constituted by a plurality of pins coupled to the peripheral wall portion of the inner tube and spaced apart from one another in the axial direction of the inner tube.

5. The exhaust apparatus according to claim 1, further comprising a sound absorbing material arranged in the internal space.

6. An exhaust apparatus comprising:

an inner tube including therein an exhaust passage and also including a peripheral wall portion on which a plurality of opening portions communicating with the exhaust passage are formed;

an outer tube accommodating the inner tube, an internal space being formed between the outer tube and an outer periphery of the inner tube; and a flow rectifying member arranged at a region inside the inner tube, having a spiral shape in an axial direction of the inner tube, and configured to rectify an exhaust gas flowing through the exhaust passage, wherein the flow rectifying member is constituted by a plurality of pins coupled to the peripheral wall portion of the inner tube and spaced apart from one another in the axial direction of the inner tube; and when viewed from the axial direction of the inner tube, the plurality of pins are respectively arranged at positions displaced from one another around an axis of the inner tube.

7. An exhaust apparatus comprising:

an inner tube including therein an exhaust passage and also including a peripheral wall portion on which a plurality of opening portions communicating with the exhaust passage are formed;

an outer tube accommodating the inner tube, an internal space being formed between the outer tube and an outer periphery of the inner tube; and a flow rectifying member arranged at a region inside the inner tube, having a spiral shape in an axial direction of the inner tube, and configured to rectify an exhaust gas flowing through the exhaust passage, wherein the flow rectifying member is constituted by a plurality of pins coupled to the peripheral wall portion of the inner tube and spaced apart from one another in the axial direction of the inner tube; and each of the plurality of pins has a circular cross section.

* * * * *